US005687791A

United States Patent [19]

Beck et al.

[11] Patent Number: 5,687,791

[45] Date of Patent: Nov. 18, 1997

[54] METHOD OF WELL-TESTING BY OBTAINING A NON-FLASHING FLUID SAMPLE

[75] Inventors: Harold Kent Beck, Canyon, Tex.; Roger Lynn Schultz, Stillwater, Okla.

[73] Assignee: Halliburton Energy Services, Inc., Dallas, Tex.

[21] Appl. No.: 578,842

[22] Filed: Dec. 26, 1995

[51] Int. Cl.[6] ..... E21B 49/00

[52] U.S. Cl. ..... 166/250.07; 166/264

[58] Field of Search ..... 166/250.07, 264; 175/40

[56] References Cited

U.S. PATENT DOCUMENTS

| | | | |
|---|---|---|---|
| 4,936,139 | 6/1990 | Zimmerman et al. | 175/40 X |
| 5,303,775 | 4/1994 | Michaels et al. | 166/264 |
| 5,329,811 | 7/1994 | Schultz et al. | 166/264 X |
| 5,337,821 | 8/1994 | Peterson | 166/250.07 |
| 5,377,755 | 1/1995 | Michaels et al. | 166/264 |
| 5,473,939 | 12/1995 | Leder et al. | 166/264 X |

*Primary Examiner*—William P. Neuder

*Attorney, Agent, or Firm*—William M. Imwalle; Paul I. Herman; Neal R. Kennedy

[57] ABSTRACT

Apparatus and method for testing a well and obtaining a fluid sample therefrom. The apparatus comprises a housing connectable to a tubing string and having a packer at the lower end thereof. The packer is set, and fluid is flowed from a formation or zone of interest into the chamber and then into a sampler in a controlled manner such that the fluid in the housing or sampler does not flash. In one embodiment, a pump is used to flow formation fluid; plugs are used in the housing to first flow dirty fluid and then flow clean fluid into the housing. In another embodiment, a nitrogen cushion is bled slowly to flow fluid into the housing.

21 Claims, 2 Drawing Sheets

METHOD OF WELL-TESTING BY OBTAINING A NON-FLASHING FLUID SAMPLE

BACKGROUND OF THE INVENTION

1. Field of the Invention

This invention relates to testing of oil and gas wells, and more particularly, to methods and apparatus for obtaining a fluid sample without lowering the pressure of the fluid below the bubble pressure thereof, a condition known as "flashing."

2. Description of the Prior Art

During the testing and completion of oil and gas wells, it is often necessary to test or evaluate the production capabilities of the well. This is typically done by isolating a subsurface formation or a portion of a zone of interest which is to be tested and subsequently flowing a sample of well fluid either into a sample chamber or up through a tubing string to the surface. Various data, such as pressure and temperature of the producing well fluids, may be monitoring downhole to evaluate the long-term production characteristics of the formation.

One very commonly used well testing procedure is to first cement a casing into the borehole and then to perform the casing adjacent zones of interest. Subsequently, the well is flow tested through the perforations. Such flow tests are commonly performed with a drill stem test string which is a string of tubing located within the casing. The drill stem test string carries packers, tester valves, circulating valves and the like to control the flow of fluids through the drill stem test string.

Although drill stem testing of cased wells provides very good test data, it has the disadvantage that the well must first be cased before the test can be conducted. Also, better reservoir data can be obtained immediately after the well is drilled and before the formation has been severely damaged by drilling fluids and the like.

For these reasons alone, it is often desired to evaluate the potential production capability of a well without incurring the cost and delay of casing the well. This has led to a number of attempts at developing a successful open-hole test which can be conducted in an uncased borehole.

One approach which has been used for open-hole testing is the use of a weight-set, open-hole compression packer on a drill stem test string. To operate a weight-set, open-hole compression packer, a solid surface must be provided against which the weight can be set. Historically, this is accomplished with a perforated anchor which sets down on the bottom. Another prior art procedure for open-hole testing is shown in U.S. Pat. No. 4,246,964 to Brandell, assigned to the assignee of the present invention. The Brandell patent is representative of the system marketed by the assignee of the present invention as the Halliburton Hydroflate system. The Hydroflate system utilizes a pair of spaced inflatable packers which are inflated by a downhole pump. With either of these devices, both of which have advantages and disadvantages, well fluids can then flow up the pipe string which supports the packers in the well.

Another approach to open-hole testing is through the use of pad-type wireline testers which simply press a small resilient pad against the sidewall of the borehole and pick up very small unidirectional samples through an orifice in the pad. An example of such a pad-type tester is shown in U.S. Pat. No. 3,577,781 to Lebourg. The primary disadvantage of pad-type testers is they take a very small unidirectional sample which is often not truly representative of the formation because it is "dirty" fluid which provides very little data on the production characteristics of the formation. It is also sometimes difficult to seal the pad. When the pad does seal, it is subject to differential sticking and sometimes the tool may be damaged when it is removed.

Another shortcoming of wireline formation testers which use a pad is that the pad is relatively small. If the permeability of the formation is high, hydrostatic pressure can be transmitted through the formation between the outside of the pad and the center of the pad where the pressure measurement is being made in a very short period of time. This will result in major hydrostatic pressure soon after attempting to measure formation pressure. This may limit the effectiveness of wireline formation testers in some conditions.

The methods and apparatus of the present invention solve these problems by providing for capturing or trapping of a sample after fluid has flowed for a period of time. This prevents the capturing of the "dirty" fluid which initially comes out of the formation or zone of interest, while allowing the capturing of a sample of the cleaner, more representative fluid behind the "dirty" fluid.

Another approach which has been proposed in various forms, but which to the best of our knowledge has never been successfully commercialized, is to provide an outer tubing string with a packer which can be set in a borehole, and in combination with a wireline-run surge chamber which is run into engagement with the outer string so as to take a sample from below the packer. One example of such a system is shown in U.S. Pat. No. 3,111,169 to Hyde, and assigned to the assignee of the present invention. Other examples of such devices are seen in U.S. Pat. No. 2,497,185 to Reistle, Jr.; U.S. Pat. No. 3,107,729 to Barry, et al.; U.S. Pat. No. 3,327,781 to Nutter; U.S. Pat. No. 3,850,240 to Conover; and U.S. Pat. No. 3,441,095 to Youmans.

A possible disadvantage of such a surge chamber device would be that it causes the fluid to flow quite quickly which may result in flashing of the fluid, and if this fluid flows into a sampler, the flashed fluid may not be representative of the actual formation fluid and may result in incorrect readings on pressure and temperature instrumentation. The present invention solves this problem by providing a controlled, relatively slow flowing of fluid from the formation which prevents flashing and allows a good sample to be obtained in a sampler.

A number of improvements in open-hole testing systems of the type generally proposed in U.S. Pat. No. 3,111,169 to Hyde are shown in U.S. patent application Ser. No. 08/292,131, assigned to the assignee of the present invention. In a first aspect of the invention of Ser. No. 08/292,131, a system is provided including an outer tubing string having an inflatable packer, and a communication passage disposed through the tubing string below the packer, an inflation passage communicated with the inflatable element of the packer, and an inflation valve controlling flow of inflation fluid through the inflation passage. The inflation valve is constructed so that the opening and closing of the inflation valve is controlled by a surface manipulation of the outer tubing string. Thus, the inflatable packer can be set in the well simply by manipulation of the outer tubing string and applying fluid pressure to the tubing string without running an inner well tool into the tubing string. After the packer has been set, an inner well tool, such as a surge chamber, may be run into and engaged with the outer tubing string to place the inner well tool in communication with a subsurface formation through the communication passage. There is also an embodiment with a straddle packer having upper and lower packer elements which are engaged on opposite sides of the formation.

In another aspect of this prior invention, the well fluid samples are collected by running an inner tubing string, preferably an inner coiled tubing string, into the previously described outer tubing string. The coiled tubing string is engaged with the outer tubing string, and the bore of the coiled tubing string is communicated with a subsurface formation through the circulation passage defined in the outer tubing string. Then well fluid from the subsurface is flowed through the communication passage and up the coiled tubing string. Such a coiled tubing string may include various valves for control of fluid flow therethrough. This prior invention does not include the use of a sampler downhole to obtain the fluid sample.

In the prior art methods in which a well fluid is flowed to the surface, a certain amount of time is required to carry out the operation. Also, as the fluid flows upwardly, the hydrostatic pressure decreases, and there is a greater likelihood that the fluid will flash. In the present invention, the sample is taken in a sampler near the zone of interest so that it is not necessary to flow fluid to the surface, and the sample is trapped at or near the same conditions as the fluid in the zone itself. The flashing problem is eliminated by controlling the flow of fluid from the formation and the resulting pressure drop so that the pressure of the fluid does not drop below the bubble pressure when the sample is taken.

SUMMARY OF THE INVENTION

The purpose of the method and apparatus of the present invention is to obtain a fluid sample of clean, representative fluid from a well formation or zone of interest. This is accomplished by flowing fluid from the formation through the tool without flashing of the fluid, flowing sufficient fluid so that "dirty" fluid initially flowed out of the formation or zone of interest is captured in the sampler, and then capturing the clean fluid in the sampler.

An apparatus of the invention for use in servicing a well and obtaining a fluid sample from a subsurface zone or formation comprises a housing connectable to a tubing string, a packer connected to the housing and adapted for sealingly engaging an inner surface of the well adjacent to the zone of interest, a sampler in communication with the housing, a means for flowing fluid through the packer into the housing in a controlled manner such that a fluid sample may be captured in the sampler without lowering the pressure of any fluid in the housing or sampler below the bubble point thereof. That is, the means for flowing fluid through the packer is adapted for doing so in a controlled manner such that the fluid does not flash.

In one embodiment, the means for flowing is characterized by a pump positionable in the housing and adapted for pumping fluid therefrom. A pair of plugs may be disposed in the housing. A first or upper plug is disposed above a second or lower plug. The lower plug preferably has a time delay valve disposed therein. This time delay valve has an initially open position and is actuatable to a closed position after a predetermined time delay. After actuation of the pump, the upper plug is flowed upwardly through the housing and substantially dirty fluid is moved between the upper and lower plugs. After the time delay, the valve moves to its closed position such that the lower plug is flowed upwardly through the housing and substantially clean fluid is moved below the lower plug. A sealing means is provided for sealing between the upper and lower plugs and an inner surface of the housing.

In an embodiment where the packer is an inflatable packer, the packer element of the packer is inflatable to a sealing position engaging the inner surface of the well. This inflation may be carried out by using fluid displaced by pumping the plugs downwardly through the housing.

The pump is preferably an electric pump positioned in the housing at the end of an electric wireline.

In another embodiment, the means for flowing is characterized by a gas cushion in at least a portion of the tubing string. The gas cushion may be bled to lower the pressure thereof and thereby cause fluid flow from the zone of interest. Preferably, this gas cushion is a nitrogen cushion. The gas cushion is bled relatively slowly so that the fluid does not flash.

A method of the invention comprises the steps of running the apparatus into the well, setting the packer such that the packer element is sealingly engaged with the inner surface of the well adjacent to the zone of interest, initiating fluid flow from the zone, controlling the fluid flow and corresponding pressure drop such that flashing of the fluid within the housing is prevented, and capturing a sample of the fluid in the sampler. The step of controlling the fluid preferably comprises flowing dirty fluid from the zone for a sufficient time so that clean fluid is flowing into the housing prior to the step of capturing a sample.

The step of initiating flow may comprise actuating a pump having an inlet in communication with the housing, and the step of controlling the fluid flow is characterized by controlling the pumping rate of fluid through the pump.

When the first and second plugs are disposed in the housing, the step of controlling the fluid flow comprises flowing fluid through the time delay valve in the second plug when the time delay valve is in its open position and thereby flowing the first plug upwardly through the housing, and closing the time delay valve and thereby flowing the second plug upwardly through the housing.

When the packer is an inflatable packer, the step of setting the packer may comprise pumping the first and second plugs downwardly through the housing so that fluid therebelow is displaced into the packer for inflation thereof.

Rather than using a pump, the steps of initiating fluid flow and controlling the fluid flow may comprise relatively slowly bleeding a gas cushion in the apparatus.

Numerous objects and advantages of the invention will become apparent as the following detailed description of the preferred embodiments is read in conjunction with drawings which illustrate such embodiments.

DESCRIPTION OF THE PREFERRED EMBODIMENTS

Figure 1A:
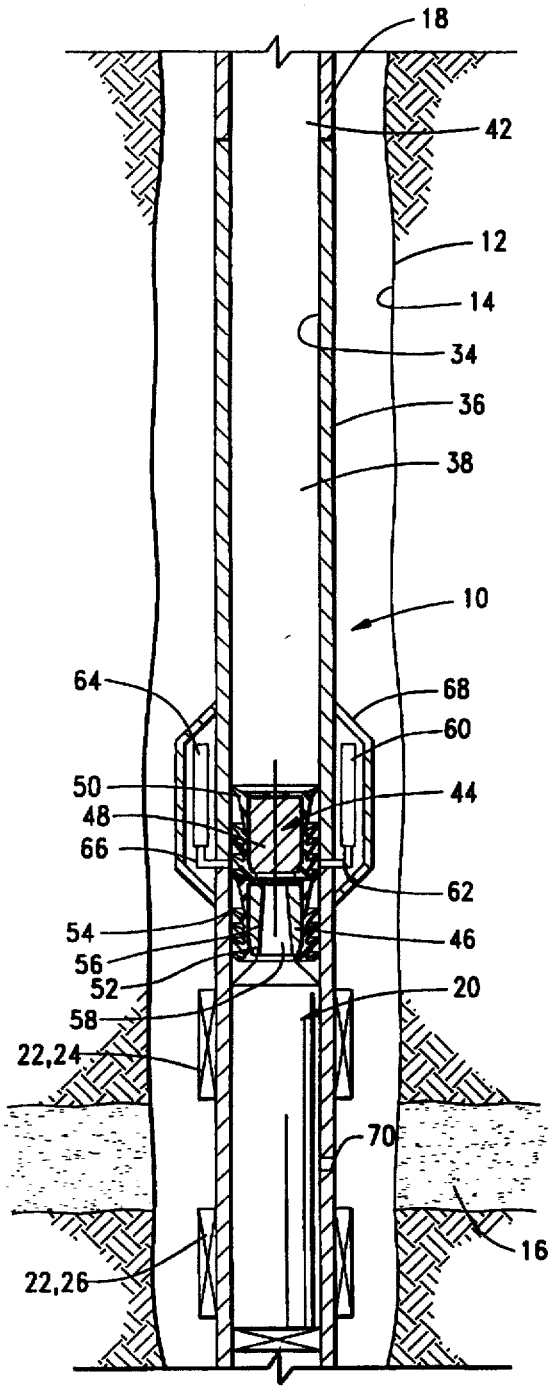
FIG. 1A–1C show a first embodiment of the method of testing a well of the present invention using a pump and plugs to control flow of formation fluid.
Figure 1B:
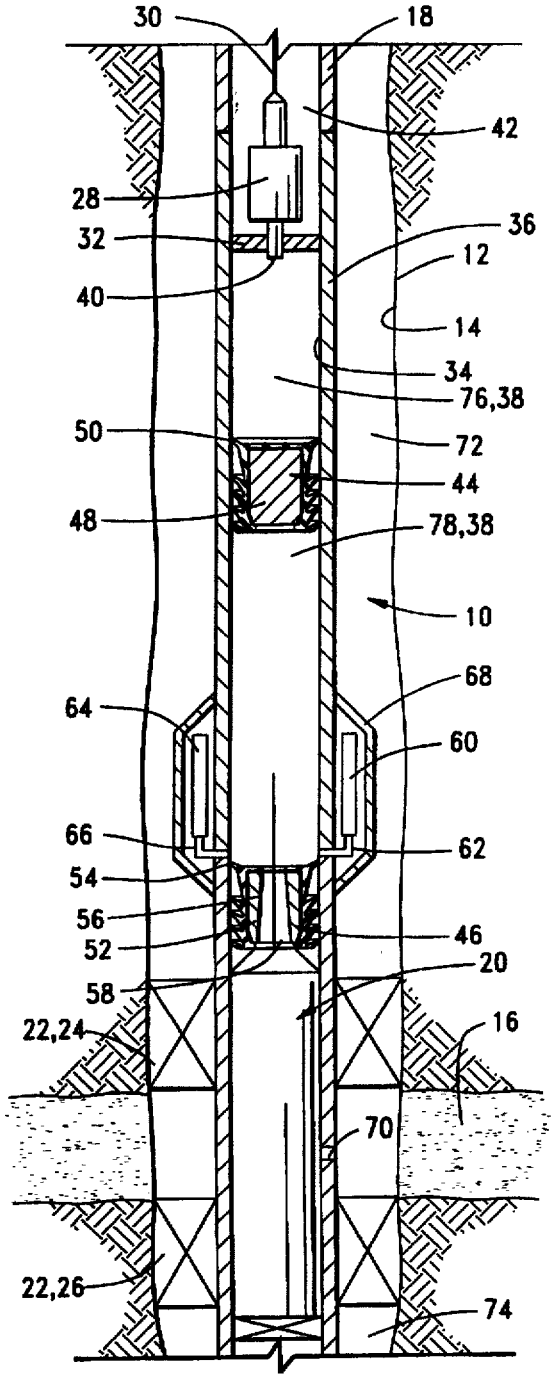
Figure 1C:
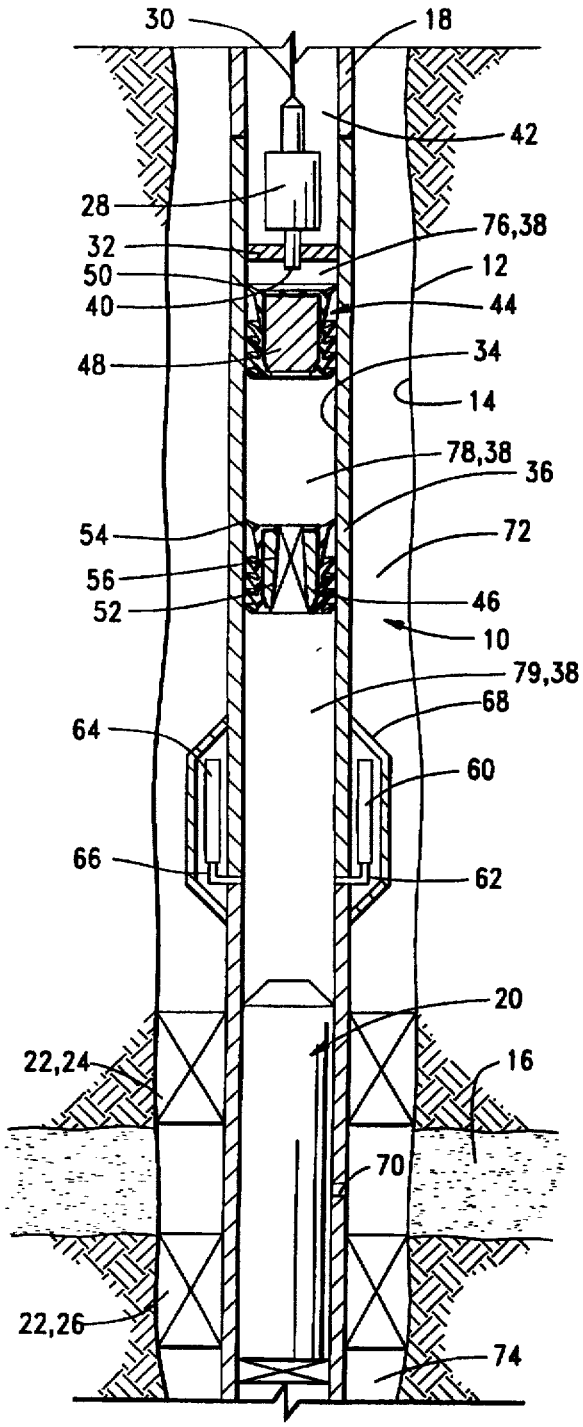

First Embodiment Of FIGS. 1A–1C

Referring now to the drawings, and more particularly to FIGS. 1A–1C. A first embodiment of the apparatus for testing a well of the present invention is shown and generally designated by the numeral 10. Apparatus 10 is shown as it is run into a well 12. Apparatus 10 is particularly well adapted for use in a well 12 having an uncased borehole 14, but the invention is not intended to be so limited. In the illustrated embodiment, borehole 14 intersects a subsurface formation or zone of interest 16. As used herein, reference to a "zone of interest" includes a subsurface formation.

Apparatus 10 is at the lower end of a tubing string 18. In a preferred embodiment, apparatus 10 includes a Halliburton Hydrospring tester assembly 20 which includes an inflatable packer 22 having upper and lower inflatable packer elements 24 and 26, respectively. Packer elements 24 and 26 are adapted to sealingly engage borehole 14 on opposite sides of formation 16 or at desired, spaced locations in a zone of interest 16. When it is not necessary to seal below formation 16 or in two places in a zone of interest, a single element inflatable packer may be used above the formation or in the zone of interest instead of straddle packer 22. That is, the apparatus is not intended to be limited specifically to a straddle packer configuration. Testing with either type of packer is essentially the same.

Further, while Hydrospring tester 20 is shown with an inflatable packer 22, the apparatus could also be configured with a compression packer as well. For example, a compression packer could be easily used when the tool is on the bottom of well 12, and an inflatable packer could be used above the bottom.

As will be further described herein, apparatus 10 is lowered into wellbore 14 as shown in FIG. 1A. Subsequently, a pump 28 is lowered down tubing string 18 and into the upper portion of apparatus 10 as seen in FIG. 1B. Pump 28 is preferably an electric pump which is lowered on a wireline 30. FIG. 1B illustrates an operating position of pump 28 spaced at a distance above Hydrospring tester 20.

A sealing means 32 sealingly engages pump 28 with an inner bore 34 of a tubular portion or housing 36 of apparatus 10. Those skilled in the art will thus see that a chamber 38 is defined in apparatus 10 between pump 28 and Hydroflate tester 20. An inlet 40 of pump 28 opens into chamber 38, and the pump discharges into central opening 42 of tubing string 18.

Prior to a sampling operation, a first or upper plug 44 and a second or lower plug 46 are positioned in chamber 38. First and second plugs 44 and 46 are shown in a downwardmost position with second plug 46 adjacent to the top of Hydrospring tester 20 and first plug 44 adjacent to the top of second plug 46. In a preferred embodiment, apparatus 10 is assembled with first and second plugs 44 and 46 in the position shown in FIG. 1A. Alternatively, first and second plugs 44 and 46 may be dropped at the surface and pumped downwardly through tubing string 18 into apparatus 10 to the position shown. As will be further described herein, this procedure might be used as part of inflation of packer 22.

First plug 44 is of a kind generally known in the art comprising a substantially solid body 48 with an outer sealing member having a plurality of wiper rings 50 extending therefrom and sealingly engaged with inner bore 34. No fluid can flow by first plug 44.

Second plug 46 comprises a body 52 with an outer sealing member having a plurality of wiper rings 54 extending therefrom and sealingly engaged with inner bore 34. No fluid can flow around the outside of second plug 46. Disposed in body 52 is a time delay valve 56. Time delay valve 56 is normally open so that a flow passage 58 is defined longitudinally through second plug 46. Thus, in the position shown in FIG. 1A, first plug 44 is in fluid communication with Hydrospring tester 20 by means of flow passage 58.

A sampler 60, such as a Halliburton Mini-sampler, is connected to housing 36 by a connector 62 or any other means known in the art. Thus, connector 62 is in communication with chamber 38.

An electronic pressure and/or temperature recording instrument 64, also referred to as a recorder 64, is connected to tubular portion 36 by a connector 66 or any other means known in the art. Recorder 66 may be similar to the Halliburton HMR. An electronic memory recording fluid resistivity tool, such as manufactured by Sonex or Madden, might be substituted for recorder 66 or used therewith.

An outer cover 68 may be positioned around housing 36, and connected thereto or forming a portion thereof, as desired to protect sampler 60 and recorder 64.

Operation Of The Embodiments Of FIGS. 1A–1C

As previously mentioned, apparatus 10 is run into well 12 to the desired depth on the end of tubing string 18 as generally seen in FIG. 1A. In one embodiment, first and second plugs 44 and 46 are disposed in housing 36 adjacent to Hydrospring tester 20 as shown. Packer 22 is set in a manner known in the art so that upper and lower packer elements 24 and 26 of the packer are placed in sealing engagement with borehole 14 adjacent to formation or zone 16, as seen in FIG. 1B. Thus, a sampling port 70 between upper and lower packer elements 24 and 26 is in communication with zone 16 and isolated from well annulus portion 72 above upper packer element 24 and well annulus portion 74 below lower packer element 26.

In the previously mentioned alternate embodiment, apparatus 10 may be positioned in borehole 14 without first and second plugs 44 and 46 being disposed in the apparatus. In this embodiment, packer 22 is an inflatable packer which is inflated by pumping first and second plugs 44 and 46 down tubing string 18. In this case, first and second plugs 44 and 46 enter housing 36 to force necessary fluid therein into packer elements 24 and 26 to inflate them. A relief or control valve (not shown) in packer 22 prevents overinflation of the packer elements. After packer 22 has been set, pump 28 is positioned in housing 36 on wireline 30, and sealing means 32 is engaged so that chamber 38 is formed between pump 28 and Hydrospring tester 20. At this point, apparatus 10 is ready for operation to obtain a sample.

Hydrospring tester 20 is operated in a manner known in the art to place flow passage 58 and second plug 46 in communication with sampling port 70. Pump 28 is energized to draw the fluid out of chamber 38. This causes formation fluid from zone or formation 16 to flow through Hydrospring tester 20 and flow passage 58 in second plug 46 so that first plug 44 is moved upwardly through tubular portion 36. See FIG. 1B. As first plug 44 thus moves, wiper rings 50 provide sealing engagement between the first plug and inner bore 34 of housing 36 so that the fluid in an upper chamber portion 76 of chamber 38 above first plug 44 is isolated from the initial formation fluid flowing into a lower chamber portion 78 formed between first plug 44 and second plug 46. This initial fluid flowing from zone or formation 16 is frequently "dirty" and not representative of the actual fluid in the formation or zone. That is, the "dirty" fluid may have debris or other materials as a result of the drilling process contained therein, and the formation fluid flowing from deeper in the formation or zone, after this initial "dirty" fluid, is much more representative.

Time delay valve 56 in second plug 46 is adapted to close, as shown in FIG. 1C, after a predetermined time delay. This time delay is selected so that valve 56 closes flow passage 58 after the "dirty" fluid has flowed and only clean fluid is flowing therethrough.

When time delay valve 56 closes flow passage 58, pressure acting upwardly on second plug 46 will cause the second plug to move upwardly through inner bore 34 of housing 36. As seen in FIG. 1C, this forms another chamber portion 79 in chamber 38 below second plug 46 and above Hydrospring tester 20. At this point, sampler 60 is activated, and a sample of fluid is taken from chamber portion 79 and captured in the sampler. Actual operation of sampler 60 is in a manner known in the art.

Recorder 64 may also be activated to take the appropriate pressure/temperature measurements as desired and send them to the surface. The actual operation of recorder 64 is also in a manner known in the art.

After completion of the test, apparatus 10 is retrieved to the surface. There, sampler 60 is removed. Sampler 60 may be drained on location, its contents may be transferred to a sample bottle for shipment to a pressure-volume-test (PVT) laboratory, or the entire sampler 6b may be shipped to a PVT laboratory for fluid transfer and testing.

Memory gauges and recorders 64 may be read, and the pressure, temperature and resistivity data analyzed to determine formation or zone pressure and temperature, permeability, and sample fluid resistivity.

Figure 2:
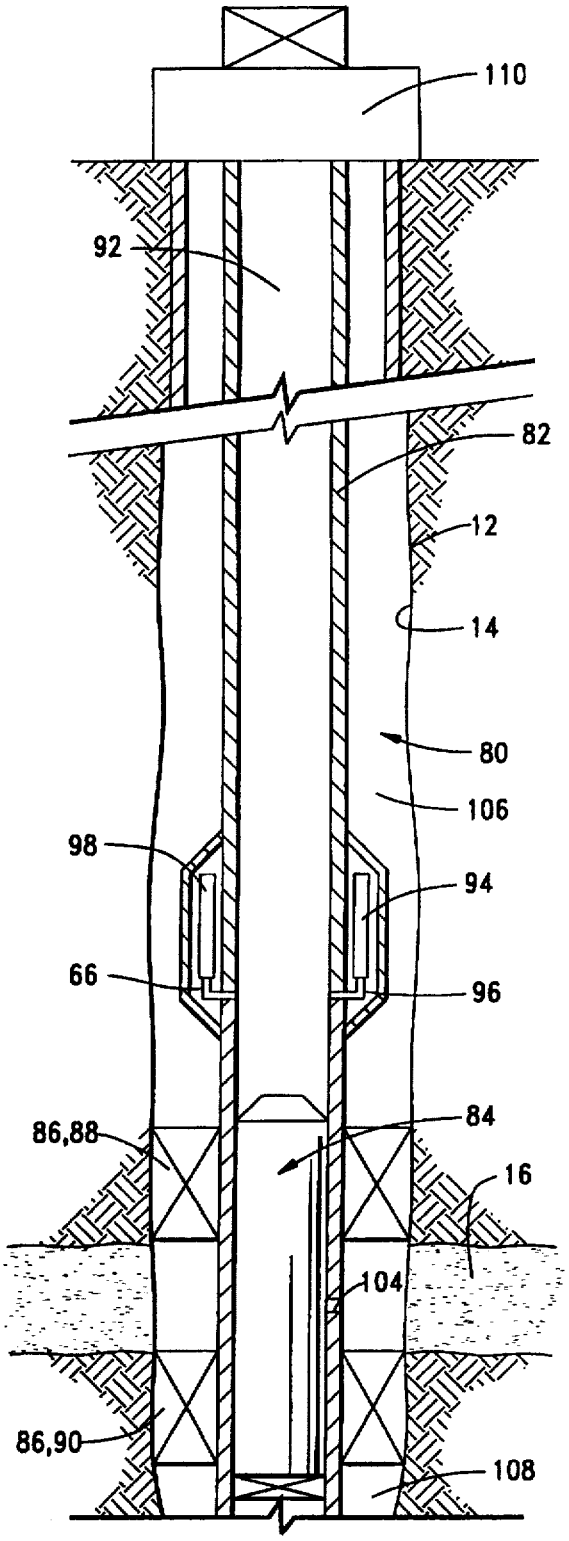
FIG. 2 illustrates a second embodiment of the present invention which utilizes a nitrogen cushion for controlling fluid formation flow.

Second Embodiment Of FIG. 2

Referring now to FIG. 2, a second embodiment of the apparatus for testing a well of the present invention is shown and generally designated by the numeral 80. Apparatus 80 is shown as it is in an operating position in well 12. As with first embodiment apparatus 10, second embodiment apparatus 80 is particularly well adapted for use in a well 12 having an uncased borehole 14, but the invention is not intended to be so limited. Again, borehole 14 intersects a subsurface formation or zone of interest 16.

Apparatus 80 is at the lower end of, or forms a lower portion of, a tubing string 82. In a preferred embodiment, apparatus 80 includes a Halliburton Hydrospring tester assembly 84 which includes an inflatable packer 86 having upper and lower inflatable packer elements 88 and 90, respectively. As shown in FIG. 2, packer elements 88 and 90 are sealingly engaged with borehole 14 on opposite sides of formation 16 or if desired, spaced locations in a zone of interest 16. As with the first embodiment, when it is not necessary to seal below formation 16 or in two places in a zone of interest, a single element inflatable packer may be used above the formation or in the zone of interest instead of straddle packer 86. That is, the apparatus is not intended to be limited specifically to a straddle packer configuration. Testing with either type of packer is essentially the same.

Further, while Hydrospring tester 84 is shown with an inflatable packer 86, apparatus 80 could also be configured with a compression packer as well. For example, a compression packer could easily be used when apparatus 80 is on the bottom of well 12, and an inflatable packer could be used above the bottom.

Tubing string 82 defines a central opening 92 therethrough, and at least a portion of central opening 92 is filled with a gas such as nitrogen. Thus, central opening 92 may also be referred to as a nitrogen or gas cushion 92.

A sampler 90, such as a Halliburton Mini-sampler, is connected to tubing string 82 by a connector 96 or any other means known in the art. Thus connector 96 is in communication with nitrogen cushion 92.

An electronic pressure and/or temperature recording instrument 98, also referred to as a recorder 98, is connected to tubing string 82 by a connector 100 or any other means known in the art. Recorder 98 may be similar to the Halliburton HMR. An electronic memory recording fluid resistivity tool, such as manufactured by Sonex or Madden, might be substituted for recorder 98 or used therewith. An outer cover 102 may be positioned around tubing string 82, and connected thereto or forming a portion thereof, as desired to protect sampler 94 and recorder 98.

Operation Of Second Embodiment

Apparatus 80 is run into well 12 to the desired depth on the end of tubing string 82 and packer 86 is set so that a sampling port 104 between upper and lower packer elements 88 and 90 is in communication with formation or zone 16 and sealingly separated from upper well annulus portion 106 above upper packer element 88 and lower well annulus portion 108 below lower packer element 90.

A control head 110 at the surface is operated to bleed the nitrogen from the nitrogen cushion 92. At approximately the same time, Hydrospring tester 20 is operated in a manner known in the art to place the lower end of central opening 92 in communication with sampling port 104. The bleeding of nitrogen from nitrogen cushion 92 causes the pressure to drop and this in turn causes formation fluid from zone or formation 16 to flow through Hydrospring tester 84 and into the lower end of central opening 92. First, "dirty" fluid will flow into central opening 92, and after a period of time, clean fluid will enter. At this point, sampler 94 and recorder 98 may be activated in the manner previously described for the first embodiment. Apparatus 80 may then be retrieved to the surface and the sample handled in the same manner as previously described.

In either embodiment, it will be seen that the control of fluid from chamber 38 or 92 allows clean fluid flow to sampler 60 or 94 in a controlled manner. The pressure drop resulting from the actuation of pump 28 or the bleeding of nitrogen cushion 92 in first embodiment 10 and second embodiment 80, respectively, is such that the fluid flowing does not flash. That is, the pressure drop is controlled so that the pressure is not allowed to drop below the bubble point of the oil contained in the fluid. When the pressure of a fluid drops below the bubble point, a phase change will occur as gas breaks out of solution. This is an undesirable situation which can result in non-representative samples and incorrect pressure and temperature measurements and can even result in a hazardous condition. In the present invention, control of the flow and corresponding pressure drop is maintained to prevent this flashing.

It will be seen, therefore, that the apparatus and method of testing a well of the present invention is well adapted to carry out the ends and advantages mentioned as well as those inherent therein. While presently preferred embodiments have been shown for the purposes of this disclosure, numerous changes in the arrangement and construction of parts and in the method of testing may be made by those skilled in the art. All such changes are encompassed within the scope and spirit of the appended claims.

What is claimed is:

1. A method of servicing a well, comprising the steps of:

(a) running a tool into the well, said tool comprising:

a housing;

a packer connected to said housing and having a packer element engagable with an inner surface of said well; and a sampler in communication with said housing;

(b) setting said packer such that said packer element is sealingly engaged with said inner surface of said well adjacent to a zone of interest;

(c) running a pump into the well such that an inlet of said pump is placed in communication with said housing;

(d) actuating said pump to initiate fluid flow from said zone;

(e) controlling said fluid flow and corresponding pressure drop such that flashing of fluid within said housing is presented; and (f) capturing a sample of said fluid in said sampler.

2. The method of claim 1 wherein step (e) comprises flowing dirty fluid from said zone for a sufficient time so that clean fluid is flowing into said housing prior to step (e).

3. The method of claim 1 wherein step (e) comprises controlling a pumping rate of fluid through said pump.

4. The method of claim 1 wherein said packer is an inflatable packer.

5. An apparatus for use in servicing a well and obtaining a fluid sample from a subsurface zone of interest, said apparatus comprising:

a housing connectable to a tubing string;

a packer connected to said housing and adapted for sealingly engaging an inner surface of said well;

a sampler in communication with said housing; and a pump positionable in communication with said housing and separable therefrom, said pump being adapted for pumping fluid from said housing and thereby flowing fluid through said packer into said housing in a controlled manner such that a fluid sample may be captured in said sampler without lowering the pressure of any fluid in said housing or sampler below the bubble point thereof.

6. The apparatus of claim 5 wherein said pump is an electric pump on an electric wireline.

7. The apparatus of claim 5 wherein said packer is a straddle packer.

8. The apparatus of claim 5 wherein said packer is an inflatable packer.

9. The apparatus of claim 5 wherein said packer is a compression packer.

10. A method of servicing a well, comprising the steps of:

(a) running a tool into the well, said tool comprising:

a housing;

a packer connected to said housing and having a packer element engagable with an inner surface of said well;

a sampler in communication with said housing;

a first plug disposed in said housing; and a second plug disposed in said housing, said second plug having a time delay valve therein having open and closed positions;

(b) setting said packer such that said packer element is sealingly engaged with said inner surface of said well adjacent to a zone of interest;

(c) initiating fluid flow from said zone by actuating a pump having an inlet in communication with said housing;

(d) controlling said fluid flow and responding pressure drop such that a flashing of fluid within said housing is prevented by:

flowing fluid through said time delay valve in said second plug when said time delay valve is in said open position thereof and thereby flowing said first plug upwardly through said housing; and closing said time delay valve and thereby flowing said second plug upwardly through said housing; and (e) capturing a sample of said fluid in said sampler.

11. The method of claim 10 wherein dirty fluid from said zone is trapped between said first and second plugs and clean fluid is flowed below said second plug.

12. A method of servicing a well, comprising the steps of:

(a) running a tool into the well, said tool comprising:

a housing;

an inflatable packer connected to said housing and having a packer element engagable with an inner surface of said well; and a sampler in communication with said housing;

(b) setting said packer such that said packer element is sealingly engaged with said inner surface of said well adjacent to a zone of interest by pumping first and second plugs downwardly through said housing so that fluid therebelow is displaced into said packer for inflation thereof;

(c) initiating fluid flow from said zone;

(d) controlling said fluid flow and corresponding pressure drop such that flashing of fluid within said housing is prevented; and (e) capturing a sample of said fluid in said sampler.

13. The method of claim 12 wherein:

said second plug has a time delay valve therein having open and closed positions; and step (d) comprises:

flowing fluid through said time delay valve in said second plug when said time delay valve is in an open position thereof and thereby flowing said first plug upwardly through said housing; and closing said time delay valve and flowing said second plug upwardly through said housing.

14. The method of claim 13 wherein dirty fluid from said zone is trapped between said first and second plugs and clean fluid is flowed below said second plug.

15. A method of servicing a well, comprising the steps of:

(a) running a tool into the well, said tool comprising:

a housing;

a gas cushion in said housing;

a packer connected to said housing and having a packer element engagable with an inner surface of said well; and a sampler in communication with said housing;

(b) setting said packer such that said packer element is sealingly engaged with said inner surface of said well adjacent to a zone of interest;

(c) initiating fluid flow from said zone by relatively slowly bleeding said gas cushion;

(d) controlling said fluid flow and corresponding pressure drop by relatively slowly bleeding said gas cushion such that flashing of fluid within said housing is prevented; and (e) capturing a sample of said fluid in said sampler.

16. The method of claim 15 wherein said gas cushion is a nitrogen cushion.

17. An apparatus for use in servicing a well and obtaining a fluid sample from a subsurface zone of interest, said apparatus comprising:

a housing connectable to a tubing string;

a lower plug disposed in said housing and having a time delay valve disposed therein, said time delay valve having an initially open position and being actuatable to a closed position after a predetermined time delay;

an upper plug disposed above said lower plug;

a packer connected to said housing and adapted for sealingly engaging an inner surface of said well;

a sampler in communication with said housing;

a pump positionable in said housing and adapted for pumping fluid therefrom and flowing fluid through said packer into said housing in a controlled manner such that a fluid sample may be captured in said sampler without lowering the pressure of any fluid in said housing and sampler below the bubble point thereof;

wherein:

after actuation of said pump, said upper plug is flowed upwardly through said housing and substantially dirty fluid is pumped between said upper and lower plugs; and after said time delay, said valve moves to said closed position such that said lower plug is flowed upwardly through said housing and substantially clean fluid is flowed below said lower plug.

18. The apparatus of claim 17 further comprising sealing means for sealing between said upper and lower plugs and an inner surface of said housing.

19. The apparatus of claim 17 wherein:

said packer is an inflatable packer; and a packer element of said packer is inflatable to a sealing position engaging said inner surface of said well by fluid displaced by pumping said plugs downwardly through said housing.

20. An apparatus for use in servicing a well and obtaining a fluid sample from a subsurface zone of interest, said apparatus comprising:

a housing connectable to a tubing string;

a packer connected to said housing and adapted for sealingly engaging an inner surface of said well;

a sampler in communication with said housing; and a gas cushion which may be bled to cause fluid flow for flowing fluid through said packer into said housing in a controlled manner such that a fluid sample may be captured in said sampler without lowering the pressure of any fluid in said housing and sampler below the bubble point thereof.

21. The apparatus of claim 20 wherein said gas cushion is a nitrogen cushion.

* * * * *